US005249449A

United States Patent [19]

Lee et al.

[11] Patent Number: 5,249,449

[45] Date of Patent: Oct. 5, 1993

[54] CAN NECKING APPARATUS WITH SPINDLE CONTAINING PRESSURIZING GAS RESERVOIR

[75] Inventors: Harry W. Lee; Charles T. Payne, Jr.; Field I. Robertson, all of Chesterfield County; Robert K. Thai, Richmond, all of Va.

[73] Assignee: Reynolds Metals Company, Richmond, Va.

[21] Appl. No.: 872,484

[22] Filed: Apr. 23, 1992

[51] Int. Cl.[5] ..... B21D 41/04

[52] U.S. Cl. ..... 72/352; 72/379.4; 413/69

[58] Field of Search ..... 72/57, 94, 352, 356, 72/379.4; 413/69

[56] References Cited

U.S. PATENT DOCUMENTS 3,812,696 5/1974 Kneusel et al. .
4,446,714 5/1984 Cvacho .
4,457,158 7/1984 Miller et al. .
4,693,108 9/1987 Traczyk et al. .
4,723,430 2/1988 Hahn .
4,732,027 3/1988 Traczyk et al. .
4,801,241 1/1989 Zajac et al. .
4,844,358 7/1989 Kamp .
4,860,519 8/1989 Lemaire et al. .
4,922,276 5/1990 Lamprecht et al. .
5,018,379 5/1991 Shirai et al. ..... 413/69

*Primary Examiner*—Lowell A. Larson
*Attorney, Agent, or Firm*—Robert C. Lyne, Jr.

[57] ABSTRACT

A method and machine for forming can necks in metal container bodies is disclosed. The machine comprises a pilot assembly coaxially situated and longitudinally movable with respect to and within a necking die member having an annular static die forming surface longitudinally advanced into contact with the can side wall defining the open end. Prior to necking, the pilot assembly is inserted into the open end and then stopped. Continued forward movement of the necking die member opens a valve between the pilot assembly and die member to flow pressurized fluid from a reservoir in the pilot to pressurize the can. This prevents crushing of the can under necking loads. The reservoir is located entirely within the pilot shaft and has a dimensional volume greater than the can body interior volume. This results in rapid delivery of pressurized fluid into the can before the greatest necking loads are applied to the side wall.

35 Claims, 5 Drawing Sheets

CAN NECKING APPARATUS WITH SPINDLE CONTAINING PRESSURIZING GAS RESERVOIR

TECHNICAL FIELD

The present invention relates generally to an improved method and apparatus for the necking-in of side walls defining open ends of metal can bodies in the manufacture of metal cans and, more particularly, to an improved method and apparatus for static die necking of metal can open ends in conjunction with introducing compressed air into the can body interior to prevent crushing under necking loads.

BACKGROUND ART

Static die necking is a process whereby the open ends of can bodies are provided with a neck of reduced diameter utilizing a necking tool having reciprocating concentric necking die and pilot assemblies that are mounted within a rotating necking turret and movable longitudinally under the action of a cam follower bracket to which the necking die assembly is mounted. The cam follower bracket thereby rotates with the turret while engaging a cam rail mounted adjacent and longitudinally spaced from the rear face of the necking turret. A can body is maintained in concentric alignment with the open end thereof facing the necking tool of the concentric die and pilot assemblies for rotation therewith. The reciprocating pilot assembly is spring loaded forwardly from the reciprocating die member. The forward portions of the die member and pilot assembly are intended to enter the open end of the can body to form the neck of the can.

More specifically, the die member is driven forwardly and, through its spring loaded interconnection with the pilot assembly, drives the pilot assembly forwardly toward the open end of the can. The outer end of the pilot assembly enters the open end of the can in advance of the die member to provide an anvil surface against which the die can work. The forward advance of the pilot assembly is stopped by the engagement of a homing surface on the necking turret with an outwardly projecting rear portion of the pilot assembly, slightly before the forward portion of the die member engages the open end of the can. As the die member continues to be driven forwardly by the cam, its die forming surface deforms the open end of the can against the anvil surface of the pilot assembly to provide a necked-in end to the can body.

A necking machine of the type discussed above is disclosed, for example, in U.S. Pat. Nos. 4,457,158 and 4,693,108. In the latter '108 patent, each necking station also has a container pressurizing means in the form of an annular chamber formed in the pilot assembly which acts as a holding chamber prior to transmitting the pressurized fluid into the container from a central large reservoir located in the necking turret. In the type of static die necking discussed above to which the present invention pertains, pressurized fluid internally of the container is critical to strengthen the column load force of the side wall of the container during the necking process. There are particular problems inherent in introducing sufficient pressurized fluid into the container as the speed of production is increased.

It is accordingly one object of the present invention to enable rapid pressurization of the container body interior by air flowing to it through the pilot assembly shaft.

Another object is to rapidly pressurize the can interior to sustain high peak necking loading without crushing by placing a large volume reservoir in the necking spindle assembly immediately adjacent the can interior.

Still another object is to substantially instantaneously flow pressurized air from the reservoir into the can interior through a valve means having large diameter inlet ports communicating between the reservoir and can interior.

DISCLOSURE OF THE INVENTION

Apparatus for necking the side wall forming an open end of a metal can body, in accordance with the present invention, comprises a necking turret and a necking die mounted for longitudinal reciprocating movement within the turret. A pilot assembly is coaxially longitudinally reciprocatable within the necking die. The pilot assembly includes a reservoir adapted to supply fluid under pressure through the pilot assembly and into the metal can body to pressurize the can and enable it to sustain high necking loads without crushing. The reservoir has a volume at least about equal to the volume of the can body to enable rapid pressurization to occur.

Means is provided for driving the necking die and pilot assembly forwardly toward the open end of the can body to neck the can side wall at the open end thereof, and for subsequently retracting the necking die and pilot assembly rearwardly from the necked-in open end of the can body so that the necked can may then be transferred to another work station.

The pilot assembly preferably includes a hollow pilot shaft containing the reservoir which may extend substantially the entire length of the shaft. The diameter of the reservoir corresponds to the inner diameter of the pilot shaft.

A pressurization valve is located between the pilot shaft and necking die for controlling communication between the reservoir and the can body to pressurize the interior. This control valve preferably includes a valve element mounted in the forward end of the pilot shaft and a plurality of circumferentially spaced throughbores in the valve element for high volume passage of pressurized fluid from the reservoir to the can interior. The necking die includes a valve disc at its forward end which is contactable with the valve element to selectively open and close the valve means.

The driving means includes means for initially driving the necking die and pilot shaft forwardly together toward the can body with the valve disc in contact with the valve element to close the control element. Stop means on the turret limits forward travel of the pilot shaft after the pilot assembly has entered the can interior through the open end. The necking die continues its forward travel into necking contact with the can side wall. As this occurs, the valve disc moves of the valve element to open the control valve.

In a preferred embodiment, the control valve further includes a forwardly extending portion on which rides the valve disc. The forwardly extending portion contains air passageways for communicating the throughbores with the can body interior when the valve opens. The air passageways may be plural radial passages formed adjacent the valve element and a large diameter axial bore forwardly of the radial passages for communicating same with the interior of the can.

The pilot assembly may further comprise a guide block and means for mounting the guide block to the forwardly extending portion of the valve means. The guide block includes an outer cylindrical anvil surface engaging the can side wall under the action of the necking die to define the internal diameter of the necked-in portion of the can body by coacting with the die. The mounting member may include a flange to which the valve disc is mounted in coaxial alignment with the throughbores.

A method of necking an open end of a metal container, in accordance with the present invention, comprising the steps of inserting a pilot die into the container through the open end to be necked and then contacting an exterior surface of the open end with a necking die to thereby produce a necked-in portion. The interior of the metal container is pressurized by admitting fluid into it at the onset of necking. The fluid rapidly enters the interior in sufficient quantity to withstand the necking loads from a reservoir in the pilot, wherein the volume of the reservoir is at least about equal to or greater than the volume of the metal container.

In accordance with a further feature of the invention, the reservoir is preferably continuously pressurized during necking from a supply of pressurized fluid flowing thereto.

In a preferred operating embodiment of the invention, the reservoir is pressurized to about 60 psi which enables pressurization of the container interior to about 20–25 psi within about 15 milliseconds.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF DRAWINGS

FIG. 5C is a sequential view similar to FIG. 5B depicting the necking die in its forwardmost travel position whereupon the side wall is necked-in.

BEST MODE FOR CARRYING OUT THE INVENTION

Figure 1:
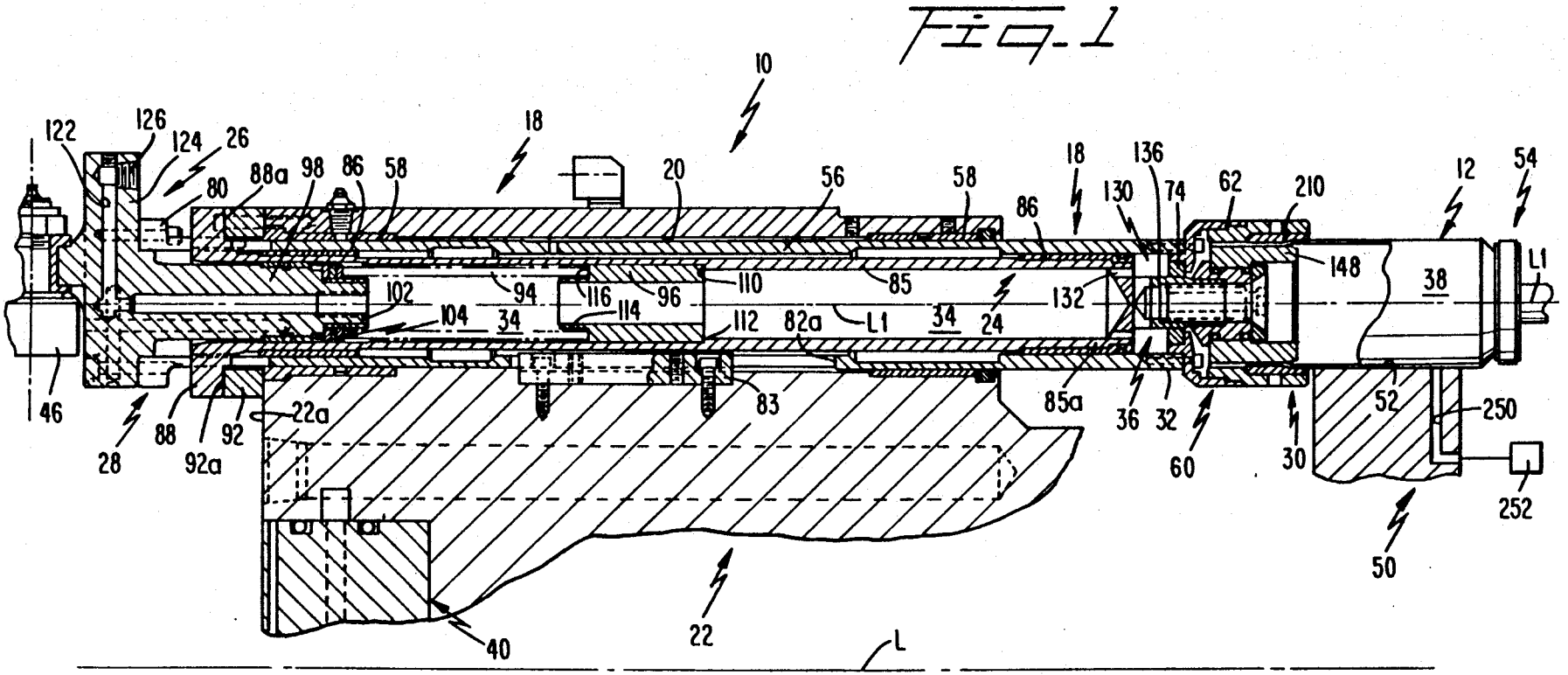
FIG. 1 is a cross-sectional view through a necking station of a necking die constructed in accordance with the principles of the present invention.

Die necking apparatus, generally indicated by reference numeral 10, will, in the position depicted in FIG. 1, neck in and reduce the diameter of a can body 12 by axially advancing into contact with the open end 14 thereof under the action of a cam 16. Die necker 10 includes a necking spindle assembly 18 slidably mounted for reciprocating longitudinal movement in an axial throughbore 20 of a rotating necking turret 22. A pilot assembly 24, coaxially carried within the necking spindle assembly 18, is initially longitudinally advanced (FIG. 5A) into the can open end 14 under the action of a cam follower bracket 26 engaging cam 16. Cam follower bracket 26 is connected to the rear end 28 of spindle assembly 18 to then longitudinally advance a necking die 30, mounted to the front end 32 of the spindle assembly, into contact with the marginal edge of the open can end 14. As will be seen more fully below, the pilot assembly 24 features a unique air pressure reservoir 34 and disc valving arrangement 36 which rapidly transmits pressurized air into the can body interior 38 through the open end 14 being necked to ensure that the can 12 has sufficient rigidity when contacted by the necking die 30.

Figure 2:
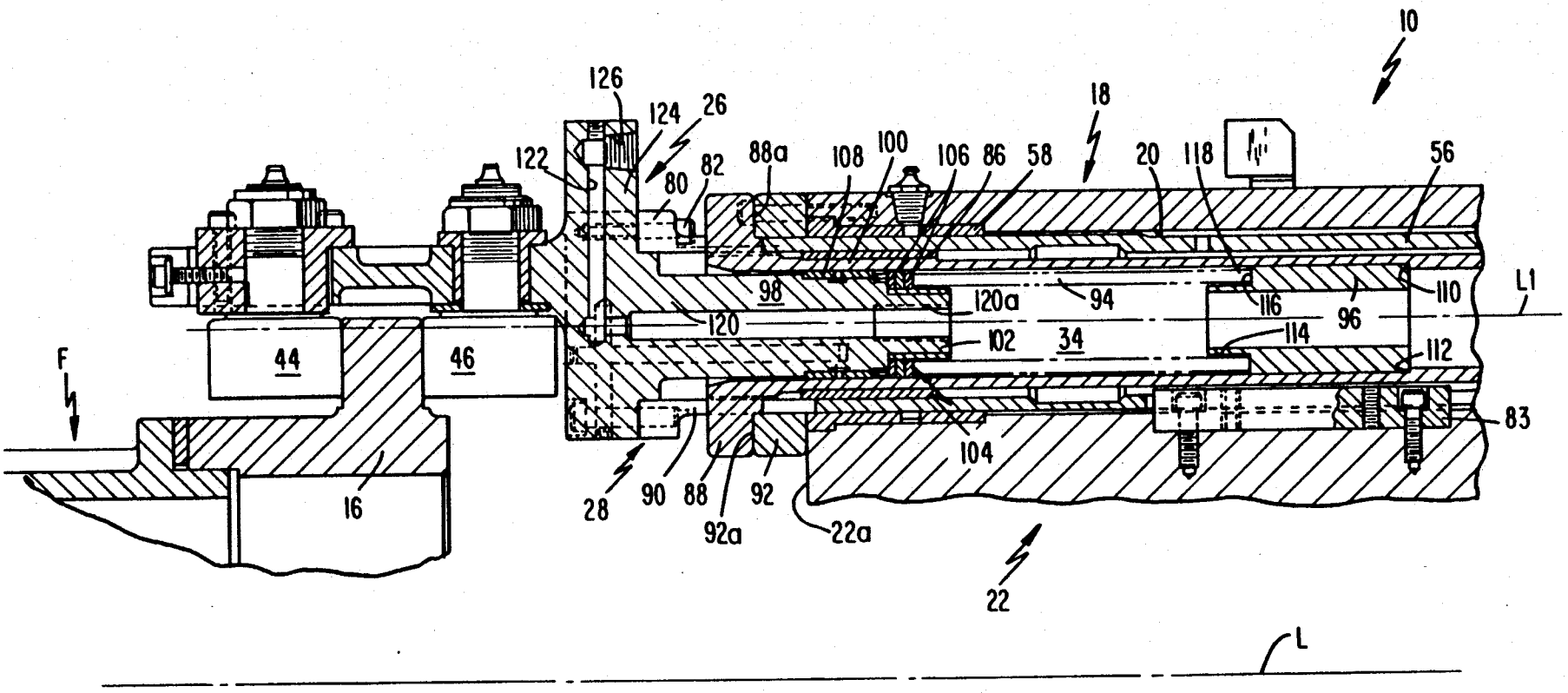
FIG. 2 is a sectional view similar to FIG. 1 but on an enlarged scale to depict further specifics of the cam drive and follower assembly at each necking station.

The rotating necking turret 22 is of cylindrical cast construction adapted to be mounted via flange or pilot diameter 40 (FIG. 1) for rotation about a central horizontal axis of rotation L. The plurality of axial throughbores 20, each housing a necking spindle assembly 18, are circumferentially spaced from each other within the periphery of the turret 22 in parallel equispaced relationship to the axis of rotation L. The cam 16 is in the form of a stationary cam rail mounted to a bracket F which is mounted to a side frame of the machine as schematically depicted in FIG. 2 and as is well known. Reciprocating movement is imparted to each necking spindle assembly 18 through a driving arrangement connected to the cam follower bracket 26 and having a pair of rollers 44 and 46 which are driven from the cam rail 16 passing between them. It will be understood that the relative axial spacing of the cam rail 16 from rear face **22*a* of the necking turret 22 varies as a function of the angular position of the necking spindle assembly 18 during its rotation about turret axis L to thereby control the degree of longitudinal reciprocating movement of the necking die 30 and pilot assembly 24** in the manner set forth more fully below.

Although not shown in detail, the unnecked can bodies 12 are fed in a known manner onto a star transfer wheel 50 where the cans are individually held by vacuum in pockets 52 circumferentially spaced along the periphery of the wheel in respective coaxial alignment with each necking spindle assembly 18. Each can body 12 has a profiled bottom of known cross-section adapted to be engaged and held in an axially stationary position by means of a retractable bottom support assembly 54 which may be of known construction. During the necking operation, star wheel 50 and bottom support assembly 54 co-rotate with necking turret 22 to maintain coaxial alignment between the necking spindle assembly 18 and the ca longitudinal axis L1.

Figure 3:
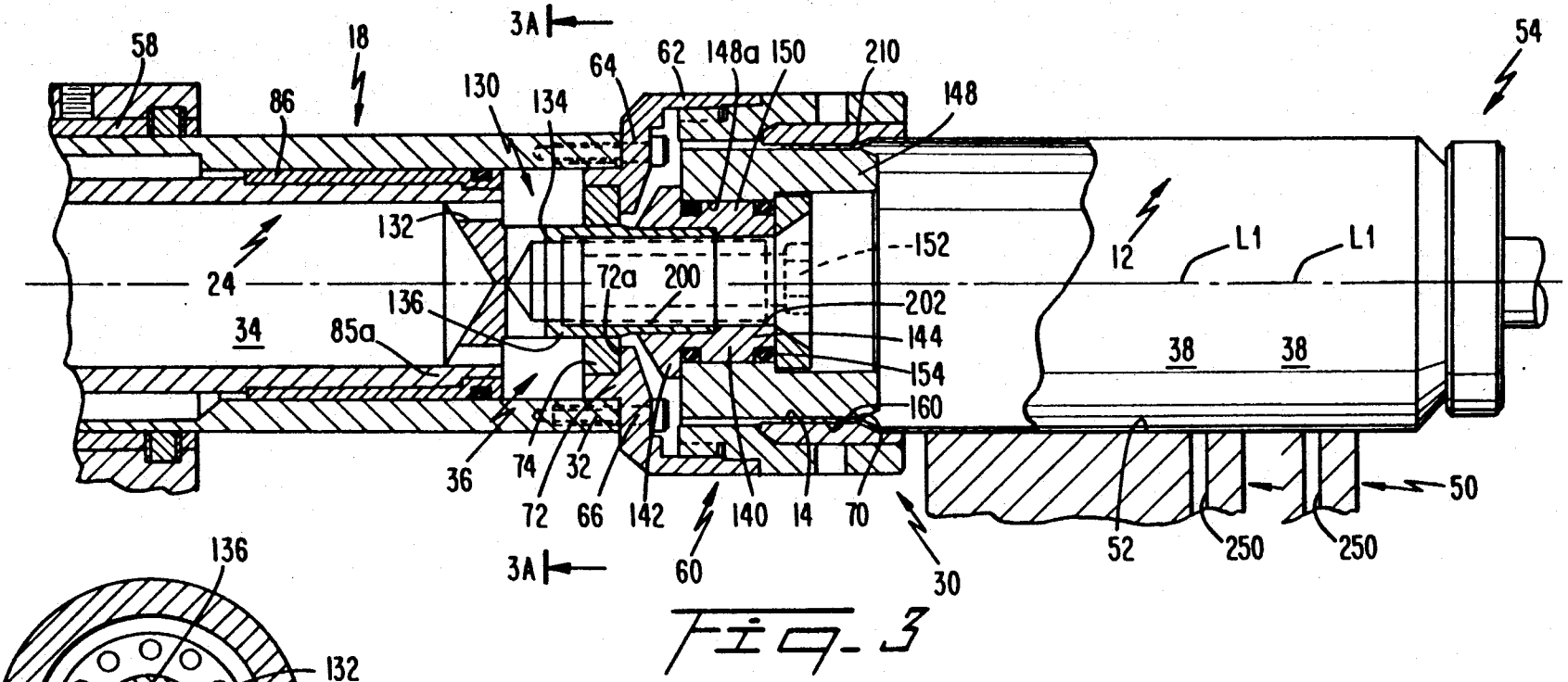
FIG. 3 is an enlarged sectional view depicting the pilot and necking guide assemblies at their end of stroke necking positions.

Referring to FIGS. 1 and 2, each necking spindle assembly 18 comprises a spindle housing in the form of a hollow shaft 56 disposed in the axial throughbore 20 of the turret in sliding contact with spindle housing bushings 58 mounted at opposite ends of each throughbore. The front end 32 of the spindle housing 18 projects forwardly from the axial throughbore 20 and carries a necking die holder 60 having a cylindrical forwardly extending die mounting portion 62 and a rear radially inward extending mounting flange portion 64 bolted to the front end 32 of the hollow shaft 56 with a plurality of mounting bolts 66. As best depicted in FIG. 3, the die mounting portion 62 supports the cylindrical necking die element 30 having a rearwardly projecting portion interfitting with the die mounting portion in press fitting engagement. The forwardmost annular portion of the necking die element 60 has a die forming surface 70 of known configuration for contacting the marginal edge 14 of the open end of the can to neck the same during forward movement of the necking spindle shaft 56 under the action of cam 16.

The mounting flange 64 of the die holder 60 further includes a radially inwardly extending valve disc holder 72 defining an annular rearward facing ledge **72*a* adapted to receive an annular valve disc 74** fitted therein for purposes described hereinafter.

The rear end 28 of the spindle housing shaft 56 is formed with a radially outward mounting flange 80 (FIG. 2) adapted to be bolted to the cam follower bracket 26 as at 82. The die forming surface 70 and the valve disc 74 thereby reciprocate longitudinally through motion imparted to the spindle housing shaft 56 by the cam follower bracket 26 and rollers 44,46 from the cam 16 during rotation of the necking turret 22 about its horizontal rotational axis L. The spindle housing shaft 56 is prevented from rotating about its axis L1 through a key 83 bolted to turret 22 and received in a slotted side wall **82*a*** of the spindle shaft.

The pilot assembly 24 is a hollow shaft 85 coaxially mounted within the spindle housing shaft 56 and supported for relative sliding movement through a pair of bushings 86 disposed at opposite ends of the spindle housing shaft. The pilot shaft 85 has at its rear end a co-acting means in the form of a pair of radially outwardly projecting portions 88 extending through a corresponding pair of slots 90 formed in the rear end 28 of the spindle housing shaft 56 just forwardly of the mounting flange 80. As shown in FIG. 1, the outwardly projecting co-acting portions 88 will engage, at their front radial faces **88*a*, a stationary bumper ring 92 mounted to the rear face 22*a* of the necking turret 22 as the pilot assembly 24 is moved forwardly by the cam follower bracket 26 into its forwardmost position limited by the bumper ring 92**.

As the die member 30 is still moved forwardly by the cam follower bracket 26, the arrested motion of the pilot shaft 85 compresses a spring 94 extending between a spring guide 96, mounted within the hollow pilot shaft 85, and forwardly axially extending portion (spring mounting member) 98 of the cam follower bracket 26 received within the rear end 100 of the pilot shaft 85. The rear end 100 of the pilot shaft 85 is slidable with respect to the forward portion 98 of the cam follower bracket 26 extending coaxially therewithin. The forwardmost portion 102 of the spring mounting member 98 is of reduced diameter for insertion in the rear end of the spring 94 and also defines a forward-facing annular spring engaging surface 104 against which the rearwardmost end of the spring 94 rests. This spring engaging surface 104 is actually defined by a pair of thrust washers 106. A bushing 108 is disposed between the spring mounting portion 98 of the cam follower bracket 26 and the inner surface of the rear end 100 of the pilot shaft 85, forwardly of the outwardly projecting portions 88.

The spring guide 96 is maintained in an axially stationary position within the pilot shaft 85 by means of a rear facing annular ledge 110 engaging the forwardmost peripheral edge 112 of the spring guide. The rearwardmost portion 114 of the spring guide 96 is of reduced diameter (corresponding to the reduced diameter of the forwardmost portion 102 of the spring holder 98) to define a rearward facing annular surface 116 receiving the front end 118 of the spring 94. This rearward surface 116 defines a spring driven surface which, during initial forward movement of the cam follower bracket 26, acts to drive the pilot shaft 85 forwardly through the compressive force of the spring 94 transmitted to the spring guide 96 through the forwardly moving spring holder 98 of the cam follower bracket until the outwardly projecting portions 88 of the pilot shaft 85 engage the rearward facing stop surfaces **92*a* of the stationary bumper ring 92. At that time, the die member 30 is still moved forwardly by the cam follower bracket 26 and this motion compresses the spring 94 between the spring engaging surface 104 of the spring holder 98 and the spring driven surface 116 of the spring guide 96**.

In accordance with a unique feature of this invention, the interior hollow region of the pilot shaft 85 functions as a pressurized air reservoir 34 which is continuously supplied with pressurized air during the necking process through a longitudinally extending passageway 120 formed in the spring holder 98 of the cam follower bracket 26 which intersects a radially extending passageway 122 formed in a radially extending portion 124 of the cam follower bracket to which portion the rear mounting flange 80 of the spindle housing shaft 56 is bolted. A radially outermost end of the radial supply passage 122 has an inlet port 126 adapted to constantly communicate during necking with a source of pressurized air supplied to it through a fitting (not shown). The forwardmost end **120*a* of the longitudinally extending passage 120 communicates with the hollow interior region 34 of the pilot shaft 85 to constantly supply the pressurized air into the reservoir. By making the spring guide 96 hollow, virtually the entire length (i.e., from spring holder 98 to front end 85*a*) of the interior hollow region of the pilot shaft 85 may be utilized as a pressurized air reservoir 34**.

Figure 3A:
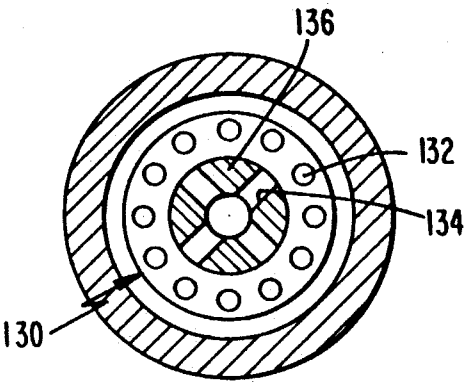
FIG. 3A is a sectional view taken along the line 3A—3A of FIG. 3.

The front end **85*a* of the pilot shaft 85 receives a unique valving element 130 formed with a plurality of axial throughbores 132 circumferentially spaced from each other along the periphery of the cylindrical valving element (FIG. 3A). In the unique manner described more fully below, the pressurized air within the reservoir 34 formed exclusively within the hollow interior region of the pilot shaft 85 is adapted to flow through these supply throughbores 132 into radially extending cross drilled passageways 134 formed in an axially forwardly extending portion 136 of the valving element 130. These axial supply throughbores 132 are selectively closed by the valve disc 74** prior to die necking as described infra.

A cylindrical guide block holder 140 has a rearwardly extending portion 142 encircling, and supported by, the forwardmost portion 136 of the valving element 130. As best depicted in FIG. 3, a leading portion 144 of the holder 140 projects forwardly from the front end of the valving element 136. A stationary cylindrical guide block 148 defining the forwardmost end of the pilot assembly 24 is mounted to a forwardly extending reduced diameter hub portion 150 of the guide block holder 140 with a bolt as at 152. A pair of seals 154 are disposed between the guide block holder 140 and the inner mounting surface 148*a* of the guide block 148 to prevent leakage of pressurized air from the can interior from between these surfaces during necking. The axially extending cylindrical outer surface 160 of the guide block 148 functions as an anvil during the necking process and defines the necked-in diameter of the can open end 14.

Figure 4:
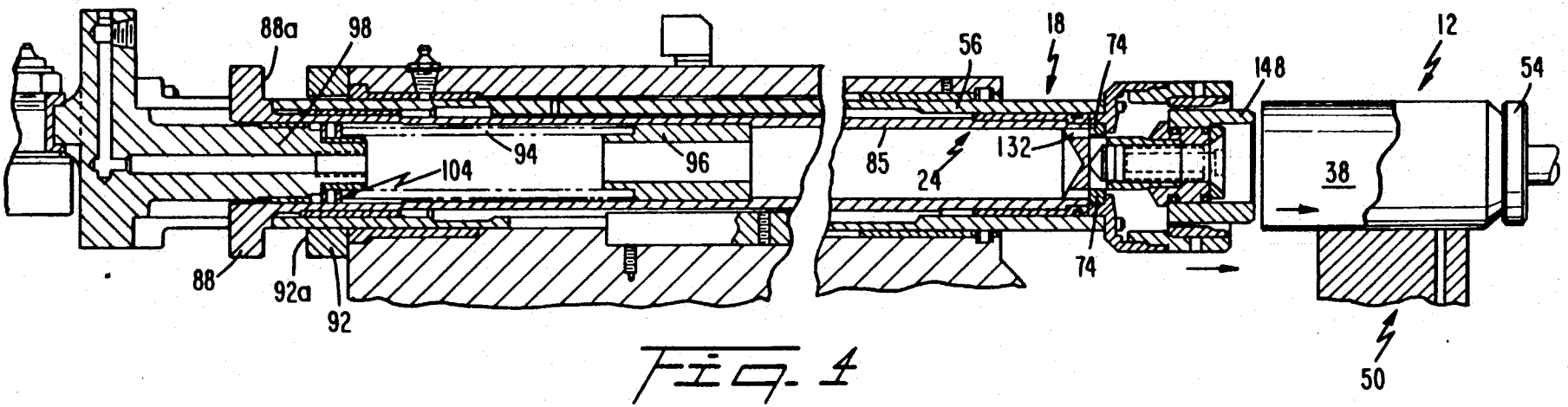
FIG. 4 is a sectional view depicting the pilot and necking die assemblies in their relative locations at the commencement of the forward necking stroke.

In operation, prior to necking (FIG. 4), the can body 12 is positioned by the star wheel 50 and the can bottom support 54 opposite the spindle assembly 18. With the can 12 in position, the spindle shaft 56 and the pilot shaft 85 are initially located relative to each other so that the valve disc 74 abuts against the air supply holes 132 of the valving element 130 to shut off the pressurized air supply to the can interior 38. The forward facing surfaces 88*a* of the rear outwardly projecting portions 88 of the pilot shaft 85 are spaced from the rear stop surfaces 92*a* of the bumper ring 92 under the action of the valve disc 74 which is stationary in the forward end of the spindle shaft 56. Residual compression in the compression spring 94 acts through the spring guide 96 to maintain the forward end 85*a* of the pilot shaft 85 and the supply holes 132 in tight sealing abutment with the valve disc 74.

Figure 5A:
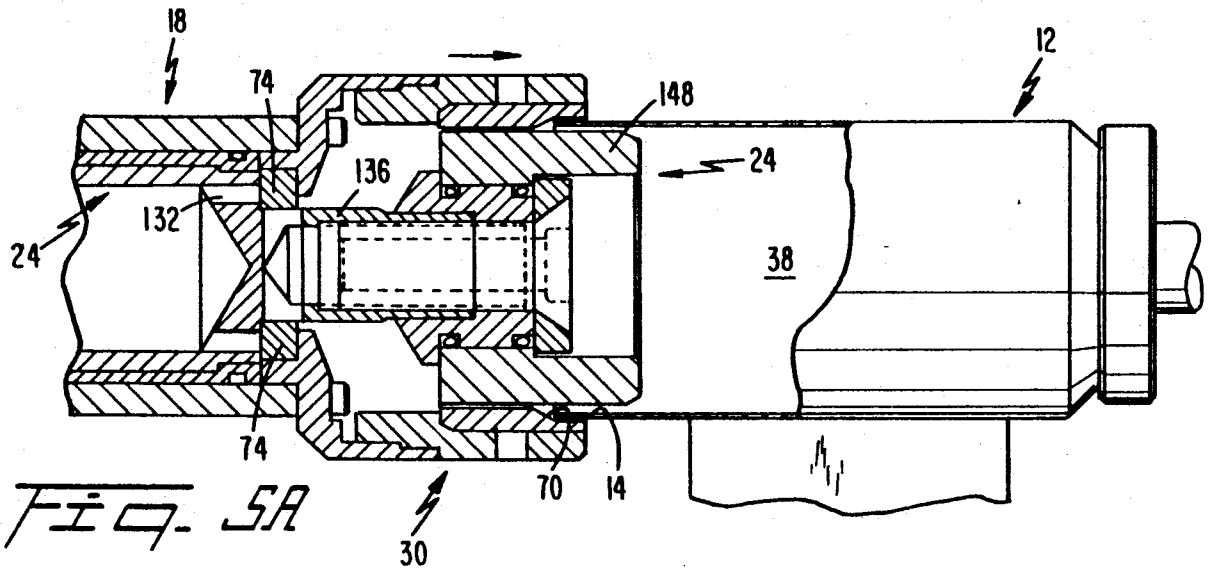
FIG. 5A is a sectional, sequential view depicting the pilot assembly as it just travels into its forwardmost position within the can open end and the necking die prior to engaging the can side wall.

As the necking turret 22 and thereby the spindle housing 18 and the can 12 co-rotate about axis L relative to the stationary cam 16, the die member 30 and the guide block 148 begin to advance axially forward together through forward movement transmitted to the spindle housing shaft 56 through the cam follower rolls 44,46 and cam follower bracket 26 and to the pilot shaft 85 through the compression spring 94 acted upon by the spring holder portion 98 of the cam follower bracket. The compression spring 94 is of sufficient stiffness to transmit such forward motion of the spring holder 98 to the pilot shaft 85. The forward movement of the die member 30 and its spring engaging surface 104 moves the pilot assembly 24 forwardly so that the guide block 148 enters the open end 14 of the can 12 as best depicted in FIG. 5A. After the pilot assembly 24 has travelled into the open end 14 of the can 12 for a predetermined distance, the forward faces 88*a* of the outwardly projecting coacting means 88 at the rear of the pilot shaft 85 contact the rearward stop surfaces 92*a* of the bumper ring 92 (FIG. 2) stationarily mounted to the rotating necking turret 22, thereby stopping the forward travel of the pilot assembly and positioning the outer cylindrical anvil surface 160 of the guide block 148 within the open end of the can body. At this point in its forward travel, the die forming surfaces 70 at the forward end of the die member 30 have not yet begun its deformation of the can body open end 14. However, it is to be understood that the valve disc 74 starts to open as soon as 88 hits 92 and before open end 14 hits anvil 160. Since the can edge 14 is inside the die 30 in sealed or air tight contact therewith at this point, air pressure in the can body begins to build.

Figure 5B:
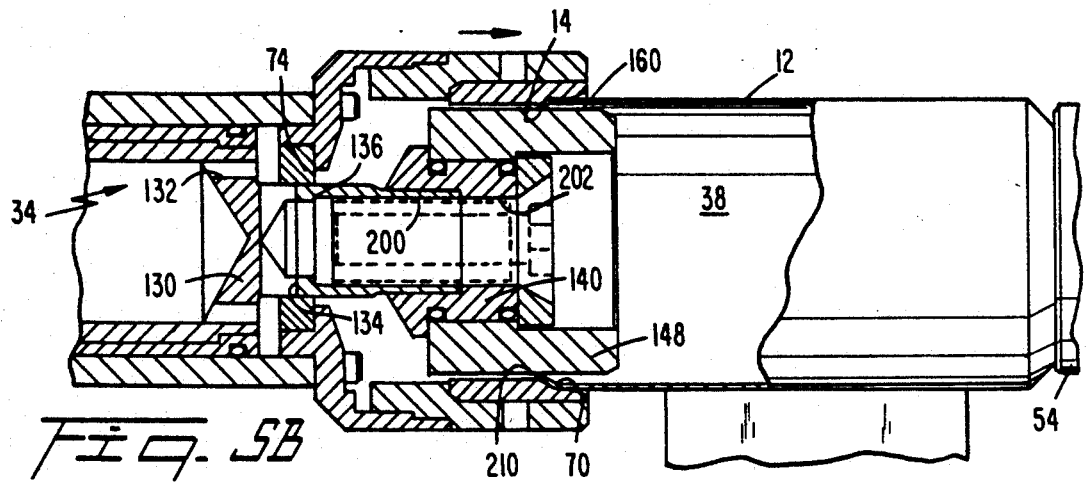
FIG. 5B is a sequential view similar to FIG. 5A as the necking die travels into initial necking contact with the can side wall with the pressurized air valve beginning to open.

As the necking turret 22 rotates further, the die forming surfaces 70 continue to axially advance into initial deforming contact (FIG. 5B) with the side wall defining open end 14 of the can body 12. This occurs under the action of further advancing movement of the spindle housing shaft 56 through the advancing cam follower bracket 26 and cam follower rollers 44,46 engaging the cam rail 16.

At this point, the die forming surfaces 70 begin to deform the open end 14 of the can body 12 against the coaxial anvil surfaces 160 of the now stationary guide block 148 to provide a necked-in portion of the can body.

Rapid pressurization of the can interior, prior to necking, advantageously occurs both by unique placement of the large volume reservoir 34 in the necking die and by high speed flow of air through the valve. The feature of plural air supply throughbores 132 in the now stationary valving element 130 enables pressurized air to be rapidly released into the can interior 38 from the air reservoir 34 through these air supply holes (i.e., which are open once coacting means 88 contacts bumper ring 92) and into the cross drilled transverse passageways 134 and thence through the large diameter longitudinal air passageway 200 of the valving element 136 communicating at its rear end with the cross drilled passageways 134. This longitudinal air passageway 200 communicates with a like diameter longitudinal passageway 202 formed in the guide block holder 140 which enables the air to enter the can interior 38.

Figure 5C:
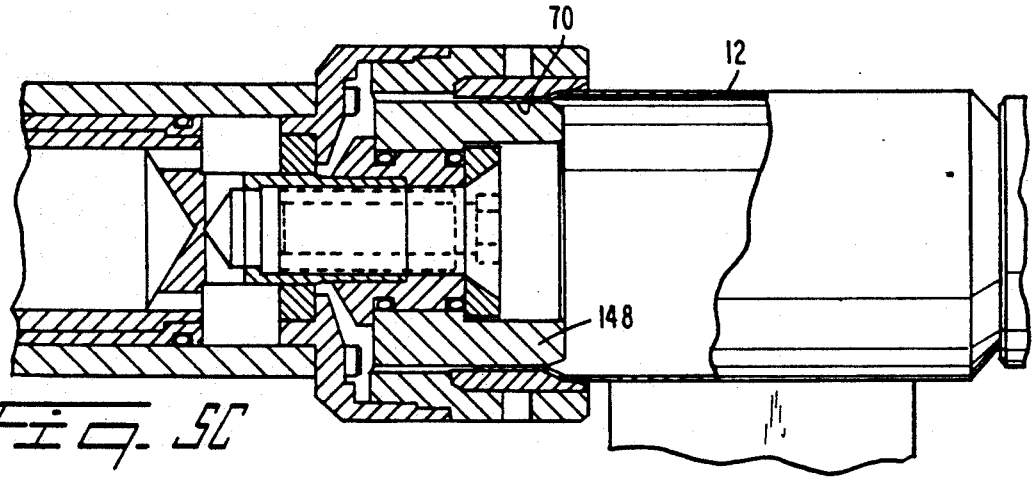
Figure 5D:
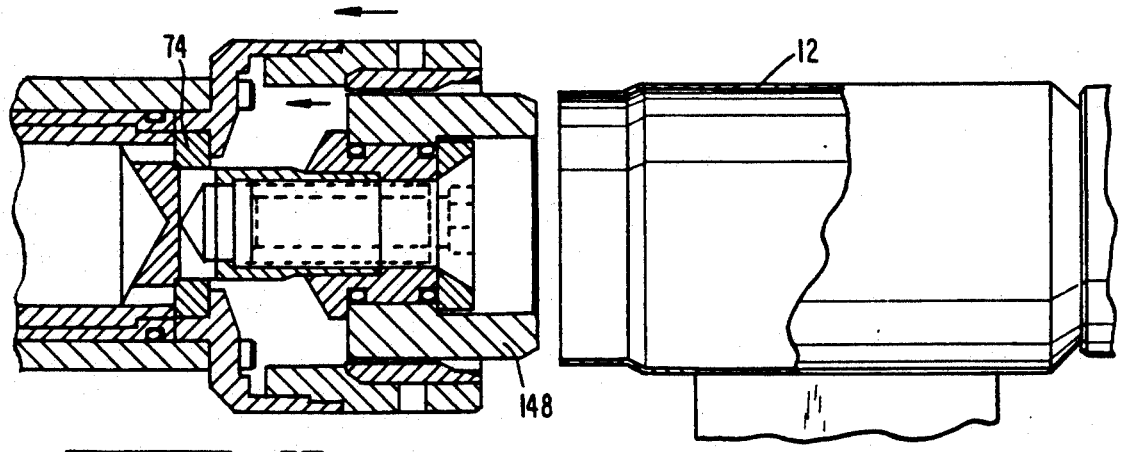
FIG. 5D is a sequential view similar to FIGS. 5A—5C immediately after retraction of the pilot and necking die assemblies.

The compressed air entering the can body 12 in the aforesaid manner will pressurize the can body and tends, through the pressure and force acting on the base of the can, to force the can away from the necking apparatus 10. However, since the can 12 is held stationary with respect to the apparatus 10 by the bottom support assembly 54, the pressurized air in the container acts to ensure that the container has sufficient rigidity when contacted by the necking die 30 to avoid buckling. The can 12 is therefore rapidly pressurized to a pressure which is based upon the pressure within the air reservoir 34 (e.g., 60 psi). As the die forming surface 70 continues to advance (FIG. 5C) through the action of the cam 16 and cam follower bracket 26, the guide block 148 through the pilot shaft 85 continues to be stationary because the outwardly projecting portions 88 of the pilot shaft are captured against bumper ring 92 with the motion of the spring holder 98 of the cam follower bracket being taken up by the compressing spring 94. The pressure within the can interior is maintained at the same level as the air pressure within the reservoir 34 until after the die forming surfaces 70 advance to the end of stroke position depicted in FIGS. 1, 3 and 5C. At this point, the die forming surfaces 70 begin to retract (FIG. 5D) through the rearward motion now imparted to the spindle housing shaft 56 through the cam follower bracket 26 acted upon by the cam follower rolls 44,46 through the cam 16. As the valve disc 74 retreats into abutting contact with the front end of the pilot shaft 85, the air supply holes 132 are sealed. Continued retreating movement of the spindle housing 56 now causes, through the valve disc 74 pressing against the front end 85*a* of the pilot shaft, corresponding retreating movement of the pilot shaft 85 and thereby the guide block 148 from the necked-in open end 14. The compressed air is released from the can interior 38 through the open end 14 around the retreating guide block 148. When the can 12 is free of the necking apparatus 10, it may be moved using known means to the next station (e.g., flanging).

As mentioned above, it is one important feature of the present invention to provide the pressurized air reservoir 34 within the necking spindle assembly 18, and particularly within the pilot shaft hollow region, to enable rapid pressurization of the can interior 38. Such rapid pressurization is necessary to avoid can buckling during the die necking process. As a result of extensive experimentation, it has been discovered that high peak axial loading of the can body 12 occurs as the open end 14 of the can curves around the radially inwardly tapered area of the die forming surfaces 70 as at 210 in FIG. 5B and strikes the anvil surfaces 160 of the guide block 148. At a nominal can forming speed of 2,000 cans per minute (CPM), it takes approximately only 15 milliseconds from the time the die forming surfaces 70 seals the can until the edge of the can contacts the guide block anvil surfaces 160 to seal the can interior 38. At the end of this elapsed predetermined time interval, it is necessary for the can interior 38 to be pressurized to a predetermined pressure (e.g., 20–25 psi) so as to adequately stiffen the can and better enable it to resist necking loading and avoid being crushed during the necking process.

Therefore, by locating the pressurized air reservoir 34 within the necking spindle assembly 18, i.e., in close proximity to the can body interior 38, a large volume of pressurized air is substantially instantaneously available to be supplied into the can body interior through the disc controlled valve 130 of the present invention. The dimensional or physical volume of the reservoir 34 is preferably at least equal to the interior volume 38 of the can body (e.g., typically twelve ounces for a standard size beverage can) and is preferably 100 percent of a volume of a standard size beverage container to ensure rapid can pressurization.

From a review of this disclosure, it will now be appreciated that the air pressure within the reservoir 34 is continuously maintained at a predetermined level (e.g., 60 psi) throughout necking so as to enable rapid pressurization of the can 12 during the aforementioned critical period when the can must be quickly pressurized to a predetermined level to enable the can to sustain high peak loading without crushing.

Another important and preferred feature of this invention is the unique disc controlled valve 130 which must enable rapid pressurization of the can body interior 38 by air flowing through it from the reservoir 34. The feature of providing a plurality of circumferentially spaced air supply through-holes 132 advantageously enables a large volume of air to flow from the reservoir 34 through the holes towards the can interior 38. The cross drilled passageways 134 (e.g., four circumferentially spaced passageways) which may be of larger diameter than the air supply holes 132, provide an effective means for enabling air supply from the throughbores to continue its high volume passage into the can interior 38. This passage is completed by the large diameter axial throughbore 200 extending through the remainder of the valving element 136 from a large diameter point of intersection with the cross drilled transverse passageways 134.

It will now occur to one of ordinary skill in the art that the large cross sectional area of the central throughbore 200 may be machined to correspond to the total cross sectional area of the cross drilled passageways 134 and that these passageways in turn may be machined so that their total cross sectional area corresponds to that of the total cross sectional area of the air supply throughbores 132. In this manner, high volume flow rates of pressurized air may be reliably maintained through the unique valve of this invention from the reservoir 34 to the can body interior 38.

The feature of continuously supplying pressurized air into the reservoir 34 through the cam follower bracket 26 assists in rapid pressurization of the can body interior 38 by minimizing or preventing pressure drop within the air reservoir to enable high speed necking to occur.

Another unique feature of this invention is the provision of air vacuum passageways, schematically depicted at 250 in FIG. 1, within the star wheel 50 which communicate with the pockets 52 to retain the can bodies on the star wheel with vacuum. Based upon a review of the instant specification, the manner in which the vacuum is supplied to each pocket 52 through vacuum passageways 250 from a vacuum source 252 will readily occur to one of ordinary skill in the art. The feature of holding the cans 12 in the pockets 52 with vacuum allows for the elimination of guide rails (not shown) which in turn eliminates the likelihood of jams from occurring between the guide rails and the cans as in the prior art.

In accordance with another feature of the instant invention, the spindle throughbores 20 formed in the necking turret 22 are preferably commonly bored with the pockets 52 to ensure perfect alignment between the die forming surfaces 70 and the central longitudinal axis L1 of the can body 12. Since the can bodies 12 do not rotate during the die necking process in this invention, it will be appreciated that the can body is centered relative to the spindle housing 18 through contact between the machined surface of the pocket with the outer surface of the can body.

It will be readily seen of one of ordinary skill in the art that the present invention fulfills all of the objects set forth above. After reading the foregoing specification, one of ordinary skill will be able to effect various changes, substitutions of equivalents and various other aspects of the inventions as broadly disclosed herein. It is therefore intended that the protection granted hereon be limited only by the definition contained in the appended claims and equivalents thereof.

We claim:

1. A method of necking an open end of a metal container, comprising the steps of:

(a) inserting a pilot die into the container through said open end to be necked;

(b) contacting an exterior surface of said open end with a necking die to thereby produce a necked-in open end; and (c) pressurizing the interior of the metal container by admitting fluid into it during step (b) from a reservoir located in the pilot die and containing pressurized fluid, wherein the dimensional volume of said reservoir is at least about equal or greater than the volume of the metal container.

2. The method of claim 1, wherein step (b) occurs as a result of relative movement between the pilot die and necking die.

3. The method of claim 2, comprising the further step of continuously pressurizing the reservoir during step (c) from a supply of pressurized fluid flowing thereto.

4. The method of claim 1, wherein said reservoir is pressurized to about 60 psi which enables pressurization of the container interior to about 20–25 psi within about 15 milliseconds.

5. A method of necking an open end of a metal container, comprising the steps of:

(a) inserting a pilot die into the container through said open end to be necked;

(b) contacting an exterior surface of said open end with a necking die to thereby produce a necked-in open end; and (c) pressurizing the interior of the metal container by admitting fluid into it during step (b) from a reservoir located in the pilot die and containing pressurized fluid, of the reservoir, said throughbores being normally closed in a relatively retracted position of the necking die by a valve element carried by said necking die, said throughbores being open as the valve element is advanced out of closing contact as a result of forward movement of the necking die into necking contact with the open end.

6. The method of claim 5, wherein said reservoir communicates with the container interior during the entire time the container is being necked.

7. The method of claim 6, comprising the further steps of moving the necking die rearwardly to begin withdrawal from the container while maintaining the pilot die substantially stationary within the container so that the valve element on the necking die contacts the valve disc to seal the reservoir from the container interior; whereby further retraction of the necking die causes retraction of the pilot die from the container interior.

8. The method of claim 7, comprising the further step of stripping said necked-in container from the dies.

9. The method of claim 8, comprising the further steps of effecting successive necked-in end portions of said container by repeating steps (a) through (c) of claim 1.

10. The method of claim 5, wherein the dimensional volume of said reservoir is at least about equal or greater than the volume of the metal container.

11. A method of necking an open end of a metal container, comprising the steps of:

(a) positioning a reservoir of pressurized fluid into alignment with the open end of the container, said reservoir having a dimensional volume of pressurized fluid at least about equal tot he volume of the container interior;

(b) flowing said pressurized fluid from the reservoir into the interior; and (c) contacting the open end with a necking die during step (b) to thereby produce a necked-in open end, whereby rapid pressurization of said container interior as a result of communicating the large volume reservoir with the container interior during necking stiffens the container to enable it to resist necking loading and avoid being crushed.

12. The method of claim 11, comprising the further step of continuously pressurizing the reservoir during step (b) from a supply of pressurized fluid flowing thereto.

13. The method of claim 11, wherein said reservoir is located in a pilot die, and comprising the further step of inserting the pilot die into the container interior, opening a valve between the pilot die and necking die to flow pressurized fluid into the interior.

14. A method of necking a side wall forming an open end of a metal can body with a necking apparatus having a die member and a pilot coaxially located in the die member that engage the side wall to form a neck in the can body, comprising the steps of:

(a) positioning the can body with its open end facing the necking apparatus;

(b) driving the necking die member and the pilot longitudinally forwardly along the axis of the can body so that the pilot enters the open end of the can;

(c) stopping the movement of the pilot after it has entered the can while continuing the movement of the die member to form a neck at the open end of the can body between forward surfaces of the die member and the pilot, wherein, during necking, pressurized fluid is supplied into the can body interior through the pilot from a reservoir of pressurized fluid within the pilot which is continuously supplied with pressurized fluid from a supply of said fluid flowing thereto during necking;

(d) beginning removal of the die member and of the pilot from the can body by driving the die member rearwardly into contact with the pilot with such contact preventing further admission of pressurized fluid into the can body interior; and (e) continuing the rearward movement of the die member and thereby the pilot so that any pressurized fluid remaining within the can body interior is released as the pilot disengages the necked-in can body open end.

15. Apparatus for necking the side wall forming an open end of a metal can body, comprising:

(a) a necking turret;

(b) a necking die mounted for longitudinal reciprocating movement within said necking turret;

(c) a pilot assembly coaxially longitudinally reciprocatable within said necking die and including a reservoir therewithin adapted to supply fluid under pressure through the pilot assembly and into the metal can body to pressurize the can and enable it to sustain predetermined high necking loads without crushing, said reservoir having a dimensional volume of pressurized fluid available for immediate delivery to the can body interior at least about equal to the volume of the can body to enable rapid pressurization to occur; and (d) means for driving the necking die and pilot assembly forwardly toward the open end of the can body to contact the can side wall and neck the can side wall at said open end thereof, and for subsequently retracting the necking die and pilot assembly rearwardly from the necked-in open end of the can body so that the necked can be transferred to another work station.

16. Apparatus of claim 15, wherein said pilot assembly includes a hollow pilot shaft containing the reservoir.

17. Apparatus of claim 16, wherein said reservoir extends substantially the entire length of the pilot shaft.

18. Apparatus of claim 17, wherein the diameter of said reservoir corresponds to the inner diameter of the pilot shaft.

19. Apparatus of claim 15, further comprising valve means, between the pilot assembly and necking die, for controlling communication between the reservoir and the can body to pressurize the can interior.

20. Apparatus of claim 15, wherein the volume of the reservoir is at least equal to the volume of a twelve ounce can body.

21. Apparatus of claim 15, further comprising means for rotating the necking turret, said driving means including a cam rail stationarily mounted adjacent the rotating turret, and cam follower means engaging the cam rail to reciprocate the necking die and pilot assembly.

22. Apparatus for necking the side wall forming an open end of a metal can body, comprising:

(a) a necking turret;

(b) a necking die mounted for longitudinal reciprocating movement within said necking turret;

(c) a pilot assembly coaxially longitudinally reciprocatable within said necking die and including a reservoir therewithin adapted to supply fluid under pressure through the pilot assembly and into the metal can body to pressurize the can and enable it to sustain predetermined high necking loads without crushing; and (d) means for driving the necking die and pilot assembly forwardly toward the open end of the can body to contact the can side wall and neck the can side wall at said open end thereof, and for subsequently retracting the necking die and pilot assembly rearwardly from the necked-in open end of the can body so that the necked can be transferred to another work station, further comprising valve means, between the pilot assembly and necking die, for controlling communication between the reservoir and the can body to pressurize the can interior wherein said pilot assembly includes a pilot shaft, and said valve means includes a valve element mounted in a forward end of the pilot shaft and a plurality of circumferentially spaced throughbores in the valve element for high volume passage of pressurized fluid from the reservoir to the can interior, said necking die including a valve disc contactable with the valve element to selectively open and close the valve means.

23. Apparatus of claim 22, wherein said driving means includes means for initially driving the necking die and pilot shaft forwardly together during forward travel toward the can body with the valve disc in contact with the valve element to close the valve means, and stop means for limiting forward travel of the pilot shaft after the pilot assembly has entered the can interior through the open end without effecting further forward travel of the necking die into necking contact with the can side wall, whereby said further forward travel moves the valve disc off the valve element to open the valve means.

24. Apparatus of claim 23, wherein said valve means further includes a forwardly extending portion on which rides the valve disc, said forwardly extending portion including air passageway means for communicating the throughbores with the can body interior when the valve means is open.

25. Apparatus of claim 24, wherein said air passageway means includes a plurality of radial passages formed adjacent the valve element and a large diameter axial bore forwardly of the radial passages for communicating same with said can interior.

26. Apparatus of claim 24, further comprising a guide block and means for mounting said guide block to said forwardly extending portion, said guide block including an outer cylindrical anvil surface engaging the can side wall under the action of the necking die to define the internal diameter of the necked-in portion of the can body.

27. Apparatus of claim 26, wherein said necking die includes a hollow spindle shaft in which said pilot shaft is coaxially slidably mounted, a necking die mounting member mounted to the forward end of the spindle shaft, and a necking die member mounted to the mounting member in radially outwardly spaced relation to the guide block.

28. Apparatus of claim 27, wherein said mounting member includes a flange to which the valve disc is mounted in coaxial alignment with the throughbores.

29. Apparatus of claim 28, further comprising a cam rail mounted adjacent the necking turret and having a cam surface, wherein said driving means includes a cam follower means, adapted to engage said cam surface, for moving said necking spindle shaft in longitudinal reciprocating strokes, said cam follower means including a cam follower bracket to which a rear portion of the necking spindle shaft is attached.

30. Apparatus of claim 29, wherein said cam follower bracket includes a forwardly extending spring mounting member engaged with the rear end of the pilot shaft mounted on the bracket, and spring means connected to the spring mounting member for normally forwardly biasing the pilot shaft so that the valve means is closed.

31. Apparatus of claim 30, wherein the rear end of the pilot shaft includes at least one radially extending projecting portion extending through a corresponding longitudinal slot formed in the rear end of the spindle shaft, wherein said necking spindle shaft and pilot shaft are initially moved forward together by the cam follower bracket until said radially outwardly projecting portion engages said stop means, whereby said spindle shaft continues forward travel under the action of the advancing cam follower bracket as the now stationary projecting portion slides relatively rearwardly through the slot as the valve means opens and the necking die member advances into necking contact with the can body.

32. Apparatus of claim 31, further comprising pressurized fluid supply passageway means in said cam follower bracket for supplying pressurized fluid to said reservoir.

33. Apparatus of claim 32, wherein the forwardly extending spring mounting member defines the rearwardmost extent of the reservoir.

34. Apparatus of claim 33, wherein said spring mounting member terminates in a rear portion of the pilot shaft.

35. The apparatus of claim 22, wherein said reservoir has a dimensional volume of pressurized fluid available for immediate delivery to the can body interior at least about equal to the volume of the can body to enable rapid pressurization to occur.

* * * * *